US009676522B1

(12) United States Patent
Stovall

(10) Patent No.: US 9,676,522 B1
(45) Date of Patent: Jun. 13, 2017

(54) PORTABLE COOLER WITH CONTOURED BOTTOM

(71) Applicant: Robert M. Stovall, S. Holland, IL (US)

(72) Inventor: Robert M. Stovall, S. Holland, IL (US)

( * ) Notice: Subject to any disclaimer, the term of this patent is extended or adjusted under 35 U.S.C. 154(b) by 0 days.

(21) Appl. No.: 14/881,860

(22) Filed: Oct. 13, 2015

Related U.S. Application Data

(60) Provisional application No. 62/101,521, filed on Jan. 9, 2015.

(51) Int. Cl.
*F25D 3/08* (2006.01)
*B65D 25/42* (2006.01)

(52) U.S. Cl.
CPC ..... *B65D 25/42* (2013.01); *F25D 3/08* (2013.01)

(58) Field of Classification Search
CPC ..... B65D 25/42; F25D 3/06; F25D 3/08
See application file for complete search history.

(56) References Cited

U.S. PATENT DOCUMENTS 3,100,054 A 8/1963 Rubens
3,811,294 A * 5/1974 Taylor ..... F25D 31/002 222/146.1
4,873,841 A * 10/1989 Bradshaw ..... A45C 5/14 280/47.17
5,172,826 A 12/1992 Celaya
5,313,817 A * 5/1994 Meinders ..... A45C 5/146 190/18 A
5,713,974 A * 2/1998 Martin ..... B01J 13/04 141/8
D442,831 S 5/2001 Jacobs
6,629,430 B2 * 10/2003 Mills ..... B65D 81/3888 62/457.2
6,783,034 B1 * 8/2004 Brent ..... B67D 1/0418 222/183
D646,852 S 10/2011 Chance et al.
8,256,242 B1 9/2012 Evans
8,740,010 B1 * 6/2014 Page ..... F25D 3/06 16/113.1
2005/0126441 A1 * 6/2005 Skelhorn ..... C04B 26/02 106/409
2006/0237923 A1 * 10/2006 Vanderberg ..... B62B 3/003 280/35
2008/0001373 A1 * 1/2008 Vaughn ..... A45C 5/146 280/47.26
2008/0112059 A1 * 5/2008 Choi ..... G02B 7/026 359/664
2008/0264953 A1 * 10/2008 Lowman ..... B67D 1/0406 220/592.19
2010/0255238 A1 * 10/2010 Derda ..... B32B 17/10 428/38

* cited by examiner

*Primary Examiner* — Frederick C Nicolas
*Assistant Examiner* — Bob Zadeh
(74) *Attorney, Agent, or Firm* — Robert C. Montgomery; Montgomery Patent and Design, LP.

(57) ABSTRACT

A cooler has a contoured bottom to allow items placed within to aggregate to one side. The cooler is equipped with a spout to enable a controlled drainage of liquids from within the cooler, located at a bottom central portion of the contoured bottom at the perimeter edge thereof. The cooler is further provided with wheels and a retractable handle to facilitate the transportation thereof.

18 Claims, 4 Drawing Sheets

PORTABLE COOLER WITH CONTOURED BOTTOM

RELATED APPLICATIONS

The present invention is a continuation of, was first described in, and claims the benefit of U.S. Provisional Application No. 62/101,521, filed Jan. 9, 2015, the entire disclosures of which are incorporated herein by reference.

FIELD OF THE INVENTION

The present invention relates generally to a cooler having a contoured bottom to allow items placed within to aggregate to one (1) side.

BACKGROUND OF THE INVENTION

Nothing is more refreshing on a hot day than a drink of an ice-cold beverage. In many instances, such a drink is provided from a large dispenser styled jug in which the beverage with ice is contained in an insulated container, and then dispensed from the bottom of the container and into a cup. Such dispensers are also found during catered events, school or work functions, athletic activities, or at construction sites. These coolers, as they are often referred to, do a fantastic job of keeping the beverage stored within cold, and in an easy to dispense state. However, such coolers are not without their faults.

Perhaps the biggest drawback of the aforementioned cooler is their inability to release all the liquid contained inside without physically manipulating the cooler by tilting or lifting. Such lifting or tilting is almost guaranteed to result in a spill as well as wasted time and energy. Accordingly, there exists a need for a means by which all liquid contents within a large insulated cooler can be easily and thoroughly dispensed. The use of the cooler with contoured bottom provides for the complete dispensing of beverages in a manner which is quick, easy, and effective.

SUMMARY OF THE INVENTION

The inventor has recognized the aforementioned lack in the art and observed that there is a need for a portable cooler having a contoured bottom.

It is therefore an object of the invention to provide a cooler which fashioned as a container having a base, a vertically upstanding sidewall about a periphery of the base to define a container interior, and a neck located along a periphery of the sidewall opposite the base. The cooler also includes a lid removably attached to the neck, a spigot in fluid communication with the interior, extending outward from the sidewall adjacent the base, at least one (1) first handle located on an exterior of the sidewall, a handle housing located on an exterior of the sidewall opposite the spigot, a second handle slidably extendable within the handle housing, and a wheel assembly affixed to a bottom of the handle housing. The base and the sidewall are composed of a material which has thermally insulative properties. The base also has an interior surface that slopes downward towards the spigot. In some embodiments the cooler neck may be threaded and the wheel assembly may be detachable.

The inner surfaces of the base and the sidewall have a waterproof liner. The outer surfaces of the sidewall comprise an infrared protective coating. The cooler may also have at least one (1) channel disposed within the sidewall and disposed between the interior and the spigot for directing contents towards the spigot. A seal ring may be located between the lid and the neck and each side handle is pivotally attached to the sidewall.

The handle housing of the cooler includes a handle slideway located within the handle housing, a pair of handle apertures located at the top of the handle slideway, an aperture seal secured within each handle aperture, and a slideway plug located at the bottom of the handle slideway. The handle housing may be integrally molded with the container. Each vertical support passes through a respective aperture seal.

The second handle consists of a pair of vertical supports each having a first and a second end, a horizontal grip connected between each first end of the pair of vertical supports, and, a handle stop secured horizontally between each second end of the pair of vertical supports.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
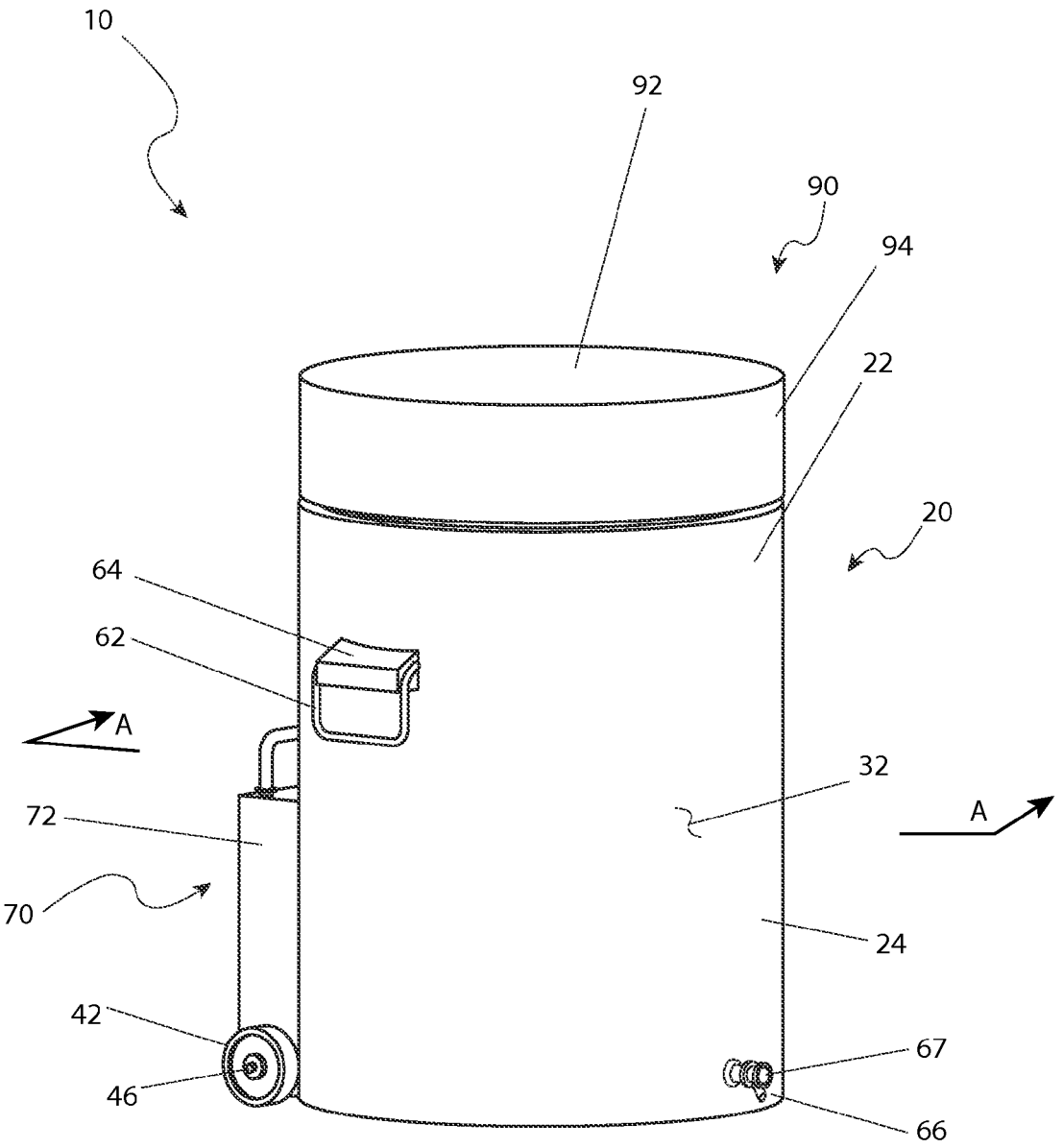
FIG. 1 is an isometric view of a cooler with a contoured bottom 10 in accordance with the preferred embodiment of the present invention.

10 cooler with contoured bottom
20 container
22 shell
24 sidewall
25 liner
26 bottom
28 interior
32 exterior
36 interior bottom
38 bottom contour
42 wheel
44 axle
46 hub
52 neck
54 opening
56 lip
58 external thread
62 side handle
64 handle pivot
66 spigot
67 spigot actuator
68 channel
70 extendable handle assembly
72 handle housing
74 handle slideway
75 extendable handle

76 vertical support
78 horizontal grip
82 handle stop
84 handle aperture
86 aperture seal
88 slideway plug
90 lid
92 disk
94 lid lip
96 internal thread
98 seal ring

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a cooler (herein referred to as the "device") 10, with a contoured interior bottom 36 which provides an insulated container 20 having a removable lid 90, and a spigot 66 configured to selectively permit the controlled drainage of any liquid contained therein. The container 20 is equipped with at least two (2) wheels 42 and an extendable handle assembly 70, as well as side handles 62, to facilitate transportation of the device 10 from one (1) location to another. While the device 10 was originally conceived to facilitate the complete drainage of chilled, or heated, liquids contained within the interior 28 it is understood that other applications may exist without limiting the scope of the invention.

Figure 2:
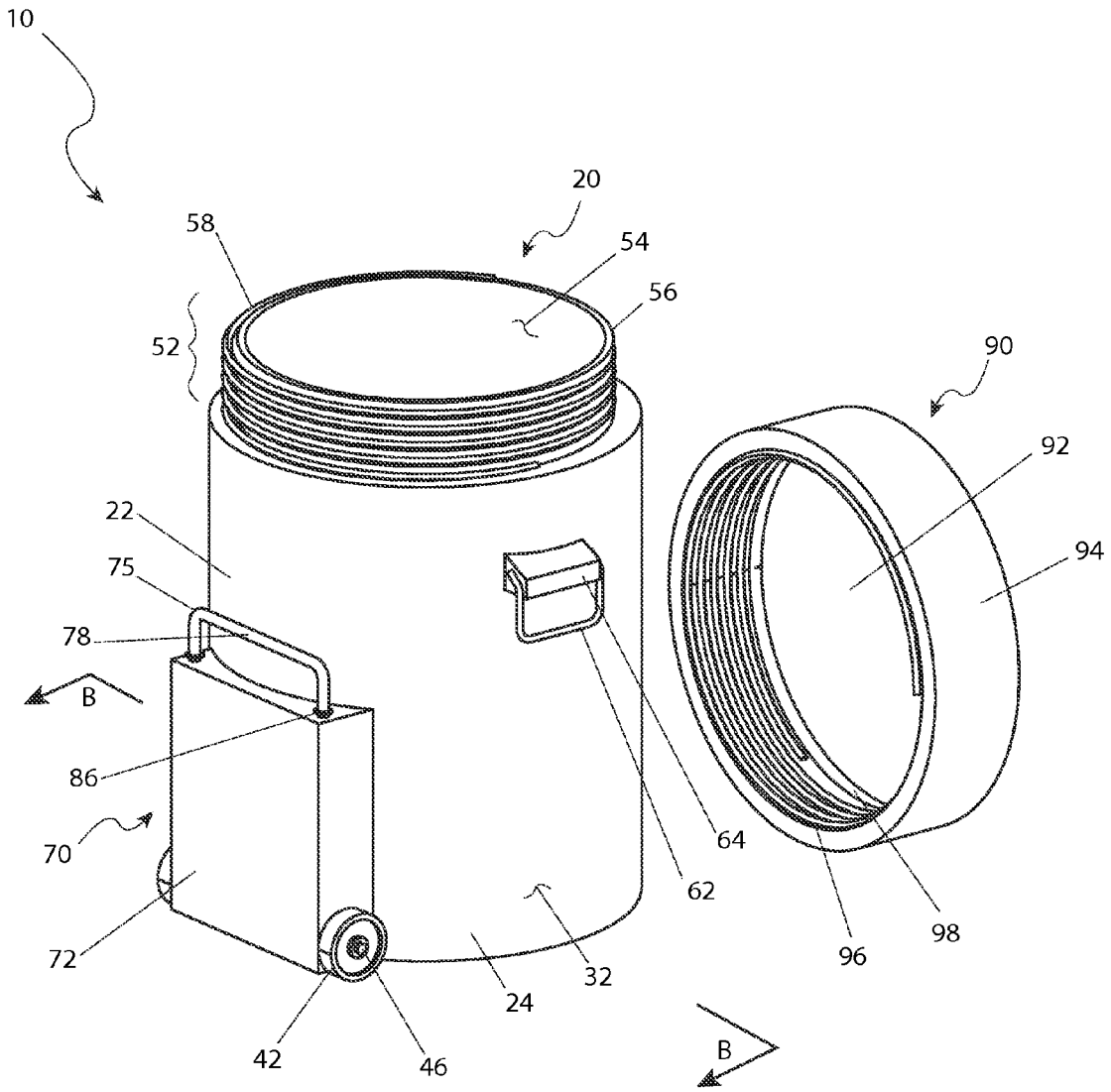
FIG. 2 is an isometric view from another vantage point of the cooler 10 with the lid 90 removed and a breakaway view of a wheel 42 in accordance with the preferred embodiment of the present invention.

Referring now to FIGS. 1 and 2, isometric views of the device 10 according to the preferred embodiment of the present invention, are disclosed. The device 10 includes a container 20 and a lid 90. The container 20 is configured to be a generally cylindrical shell 22 having a base 26 with a vertical encircling sidewall 24 joined along an abutting horizontal edge to form an interior 28. The base 26 and the sidewall 24 are composed of a formed thermoplastic material with thermally insulating properties and as such may be presented in a wide variety of colors and surface textures to suit the taste of a user. The interior 28 may be provided with a liner 25 composed of an impermeable barrier material so as to obviate any leakage or the transference of any residue to any contents placed within the container 20. The exterior 32 of the shell 22 may be provided with an infrared reflective coating to reduce the effects of radiant heat on the interior 28 of the device 10.

Figure 3:
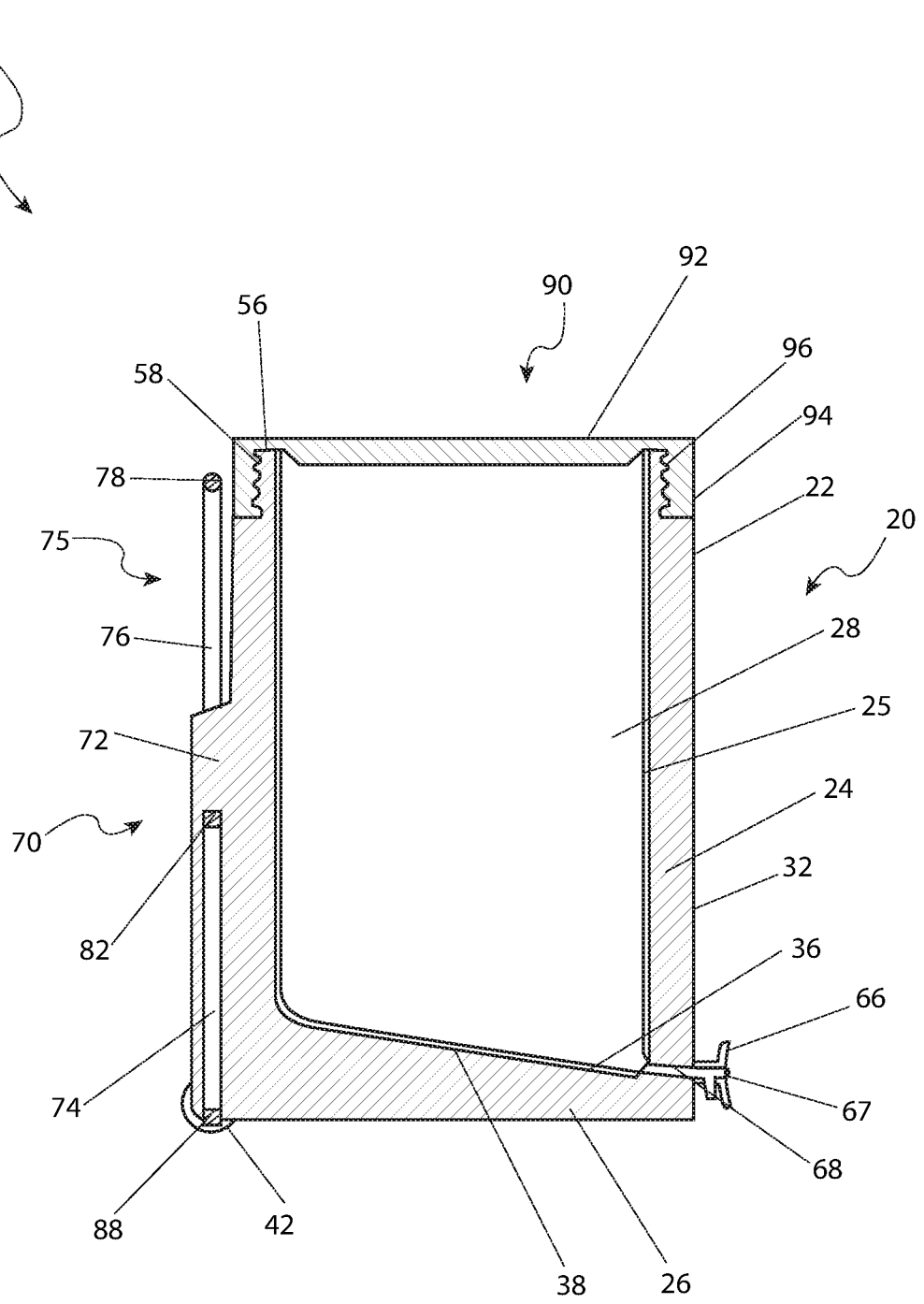
FIG. 3 is a section view along a line A-A as shown on FIG. 1 of the cooler 10 in accordance with the preferred embodiment of the present invention; and, FIG. 4 is a section view along a line B-B as shown on FIG. 2 through an extendable handle assembly 70 of the cooler 10 in accordance with the preferred embodiment of the present invention.

A spigot 66, configured to be a flow regulation and shut-off valve, is disposed at a location on the exterior 32 of the sidewall 24 corresponding to the lowest point of the interior 28 of the container 20. The spigot 66 may be any of a variety of commercially available valves, preferably composed primarily of a thermoplastic material, adapted for use with potable fluids. The spigot 66 is provided with a spigot actuator 67 which can be manipulated by a user to dispense a volume of fluid from the interior 28 of the container 20. A channel 68, as illustrated in FIG. 3, is disposed between the interior 28 and the spigot 66, through the sidewall 24, and forms a viaduct for the transfer of any fluid to the exterior 32. The location of the spigot 66 defines a nominal front of the device 10.

An upper end of the sidewall 24 is adapted to a neck 52, being slightly smaller in diameter than the sidewall 24, having a formed external thread 58 for the installation of a lid 90. The neck 52 terminates at a lip 56 surrounding an opening 54. The opening 54 of the container 20 provides an access to the interior 28 and is the primary entrance for any material placed therein. The opening 54 can be covered by a removable lid 90 to limit access to the contents of the container 20. The lid 90 is configured to be a planar thermoplastic disk 92 with an encircling lid lip 94. The lid lip 94 is provided with an internal thread 96 having a complimentary profile to the external thread 58 formed around the lip 56 so that the lid 90 may be removably installed upon the container 20. The lip 56 of the container 20 is configured to have a planar upper face capable of forming a liquid-tight seal with a seal ring 98 disposed as an annular ring around a lower face of the disk 92 in proximity to the lid lip 94. The seal ring 98 is composed of a rubber, or rubber-like, material having a sufficient thickness to be compressed between the disk 92 and the lip 56 when properly assembled to form the liquid-tight seal.

At least one (1) side handle 62 is attached to a handle pivot 64 on the sidewall 24 in proximity to the neck 52 at a location approximately ninety degrees (90°) around the exterior 32 of the shell 22 from the location of the spigot 66. The handle pivot 64 is configured to be a protrusion of the sidewall 24, being of the same constituent material, formed onto the shell 22 at the time of fabrication. The side handle 62 is adapted to have extensions pivotally inserted into apertures (not specifically illustrated) in the handle pivot 64. The side handle 62 may be pivoted away from the shell for use or turned inwardly when not in use to reduce the profile of the device 10. The side handle 62 may be utilized to lift or carry the device 10, with, or without, contents in the interior 28.

Referring now to FIG. 3, a section view along line A-A a shown in FIG. 1 of the device 10, according to the preferred embodiment of the present invention, is disclosed. A pair of wheels 42 approximately two-and-one-half inches (2½ in.) in diameter preferably composed of a nylon material is attached to integrally formed axles 44 on opposing sides of the handle housing 72 for transporting the device 10 without lifting it. The wheels 42 are retained on the axles 44 preferably with an interference spring tab hub 46. It is understood that alternate methods and means may be employed for affixing the axle 44 and the wheels 42 to the container 20 without limiting the scope of the device 10. Alternately, the axle 44 is removably attached to the container 20.

The interior 28 is configured to be essentially uniform in diameter from the lip 56 down to a bottom contour 38 defined by the sloped interior bottom 36. The interior bottom 36 is preferably pitched at a six to nine degree (6°-9°) downward slope from that side of the container 20 upon which the wheels 42 are mounted to the nominal front. The purpose of this slope from the rear to the front of the container 20 is to permit the natural flow of any liquid in the interior 28 to accumulate at the channel 68 for the eventual dispersal through the spigot 66.

Figure 4:
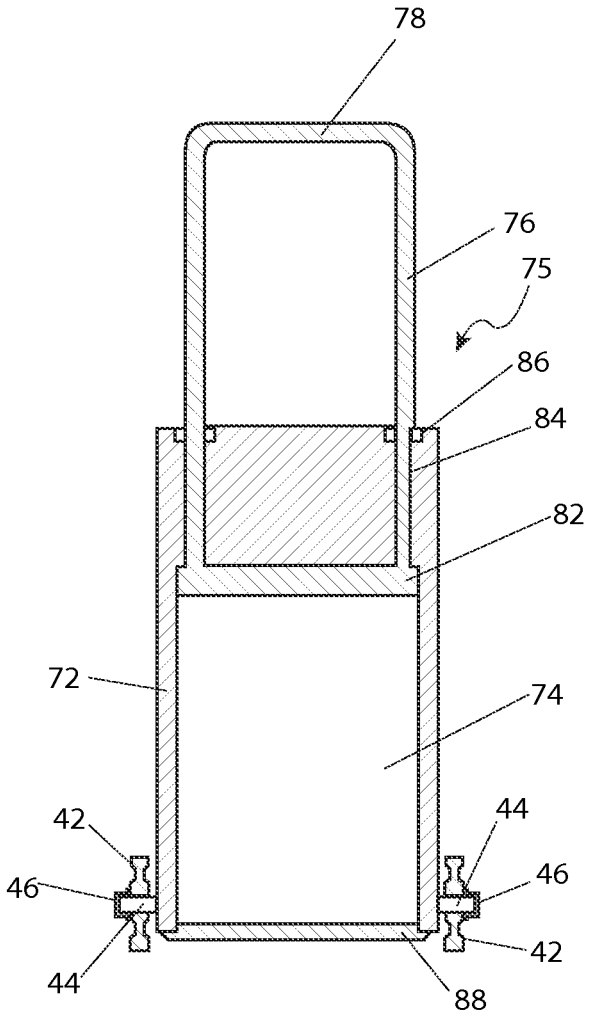

Referring now to FIG. 4, a section view along the line B-B, as seen on FIG. 2, according to the preferred embodiment of the present invention, is disclosed. The device 10 includes an extendable handle assembly 70 having a handle housing 72, with a handle slideway 74, and an extendable handle 75. The extendable handle assembly 70 is attached to the rear of the sidewall 24 for providing the impetus for motion as well as controlling the direction and speed of travel of the device 10. The handle housing 72 can be integrally molded with the shell 22, to be of the same constituent material, during fabrication of the device 10. The extendable handle 75 is preferably composed of a rigid thermoplastic formed in an injection-molding process and retracts downwardly within the handle housing 72 when not in use, as seen in FIG. 2. The extendable handle 75 includes a pair of vertical supports 76 and a horizontal grip 78 connected between upper ends of the vertical supports 76 and extends upwardly into the deployed position when in use. The vertical supports 76 move along the interior vertical handle slideway 74 formed into the handle housing 72. A handle stop 82 is placed horizontally on the ends of the vertical supports 76 of the extendable handle 75 to limit the upward travel of the extendable handle 75. The geometry of the handle slideway 74 in the handle housing 72 is configured to be sufficient to accommodate the handle stop 82 for the majority of the upward travel, but then terminate to limit the travel and keep the extendable handle 75 from becoming dislodged from the handle housing 72. That distance between the terminus of the handle slideway 74 and the top of the handle housing 73 would be provided with two (2) handle apertures 84 to accommodate the vertical supports 76 of the extendable handle 75. The top of the handle apertures 84 are preferably provided with aperture seals 86 which would seal around the vertical supports 76 of the extendable handle 75 to exclude debris and moisture from entering the handle slide way 74. The aperture seals 86 will provide a sufficient interference fit around the vertical supports 76 of the extendable handle 75 to retain the extendable handle 75 in the up position while also allowing it to easily be pushed downward when not in use. A slide way plug 88 is inserted into the lower open end of the handle slideway 74 after the handle stop 82 is installed on the extendable handle 75 at the time of manufacturing to keep out debris or other foreign matter. The extendable handle assembly 70 may be utilized by deploying the extendable handle 75 and applying a sufficient force upon the horizontal grip 78 normal to the vertical supports 76 to rotate the container 20 about the axle 44 so as to raise the bottom 26 from a support surface. The device 10 may then be pushed, or pulled, to the desired destination by a continuously exerted force upon the horizontal grip 78, transmitted through the vertical supports 76 and the handle housing 72 sufficient to cause the wheels 42 to rotate on the axle 44.

The preferred embodiment of the present invention can be utilized by an enabled individual in a simple and straightforward manner with little or no training. It can be appreciated that the operational steps can be performed in alternative order and as such any operational description of use should not be viewed as a limiting factor. After initial purchase or acquisition of the device 10, it would be arranged as indicated in FIG. 1. The method of installing and utilizing the device 10 may be achieved by performing the following steps: acquiring a model of the device 10 having a desired style to suit the taste of a user; removing the lid 90 from the container 20 by rotating the lid 90 in the correct direction; inserting the desired contents into the interior 28; reinstalling the lid 90; transporting the device 10 to the desired location either by means of the side handle(s) 62 or the extendable handle 75 and the wheels 42; placing the device 10 on an elevated horizontal support surface with the spigot 66 slightly overhanging that surface so as to have access to the spigot 66; placing a beverage serving container under the spigot 66; manipulating the spigot actuator 67 to drain the desired portion of liquid from the interior 28 into the beverage serving container; releasing the spigot actuator 67 and serving the liquid.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A cooler, comprising:

a container having a base, a vertically upstanding sidewall about a periphery of said base to define a container interior, and a neck located along a periphery of said sidewall opposite said base;

a lid removably attached to said neck;

a spigot in fluid communication with said interior, extending outward from said sidewall adjacent said base;

at least one side handle located on an exterior of said sidewall;

a handle housing located on an exterior of said sidewall opposite said spigot, comprising:

a handle slideway located within said handle housing;

a pair of handle apertures located at the top of said handle slideway;

an aperture seal secured within each handle aperture; and, a slideway plug located at the bottom of said handle slideway;

wherein said handle housing is integrally molded with said container;

an extendable handle slidably extendable within said handle housing, comprising:

a pair of vertical supports each having a first and a second end;

a horizontal grip connected between each first end of said pair of vertical supports; and, a handle stop secured horizontally between each second end of said pair of vertical supports;

wherein each vertical support passes through a respective aperture seal; and, a wheel assembly affixed to a bottom of said handle housing;

wherein said base and said sidewall is composed of material having thermally insulative properties; and, wherein said base has an interior surface that slopes downward towards said spigot.

2. The cooler of claim 1, wherein inner surfaces of said base and said sidewall have a waterproof liner.

3. The cooler of claim 1, wherein outer surfaces of said sidewall comprise an infrared protective coating.

4. The cooler of claim 1, further comprising at least one channel disposed within said sidewall and disposed between said interior and said spigot for directing contents towards said spigot.

5. The cooler of claim 1, further comprising a seal ring located between said lid and said neck.

6. The cooler of claim 1, wherein each side handle is pivotally attached to said sidewall.

7. A cooler, comprising:

a container having a base, a vertically upstanding sidewall about a periphery of said base to define a container interior, and a threaded neck located along a periphery of said sidewall opposite said base;

a lid threadably attached to said threaded neck;

a spigot in fluid communication with said interior, extending outward from said sidewall adjacent said base;

at least one side handle located on an exterior of said sidewall;

a handle housing located on an exterior of said sidewall opposite said spigot, comprising:

a handle slideway located within said handle housing;

a pair of handle apertures located at the top of said handle slideway;

an aperture seal secured within each handle aperture; and, a slideway plug located at the bottom of said handle slideway;

wherein said handle housing is integrally molded with said container;

an extendable handle slidably extendable within said handle housing, comprising:

a pair of vertical supports each having a first and a second end;

a horizontal grip connected between each first end of said pair of vertical supports; and, a handle stop secured horizontally between each second end of said pair of vertical supports;

wherein each vertical support passes through a respective aperture seal; and, a wheel assembly affixed to a bottom of said handle housing;

wherein said base and said sidewall is composed of material having thermally insulative properties; and, wherein said base has an interior surface that slopes downward towards said spigot.

8. The cooler of claim 7, wherein inner surfaces of said base and said sidewall have a waterproof liner.

9. The cooler of claim 7, wherein outer surfaces of said sidewall comprise an infrared protective coating.

10. The cooler of claim 7, further comprising at least one channel disposed within said sidewall and disposed between said interior and said spigot for directing contents towards said spigot.

11. The cooler of claim 7, further comprising a seal ring located between said lid and said neck.

12. The cooler of claim 7, wherein each side handle is pivotally attached to said sidewall.

13. A cooler, comprising:

a container having a base, a vertically upstanding sidewall about a periphery of said base to define a container interior, and a threaded neck located along a periphery of said sidewall opposite said base;

a lid threadably attached to said threaded neck;

a spigot in fluid communication with said interior, extending outward from said sidewall adjacent said base;

at least one side handle located on an exterior of said sidewall;

a handle housing located on an exterior of said sidewall opposite said spigot, comprising:

a handle slideway located within said handle housing;

a pair of handle apertures located at the top of said handle slideway;

an aperture seal secured within each handle aperture; and, a slideway plug located at the bottom of said handle slideway;

wherein said handle housing is integrally molded with said container;

an extendable handle slidably extendable within said handle housing, comprising:

a pair of vertical supports each having a first and a second end;

a horizontal grip connected between each first end of said pair of vertical supports; and, a handle stop secured horizontally between each second end of said pair of vertical supports;

wherein each vertical support passes through a respective aperture seal;

a wheel assembly removably affixed to a bottom of said handle housing;

wherein said base and said sidewall is composed of material having thermally insulative properties; and, wherein said base has an interior surface that slopes downward towards said spigot.

14. The cooler of claim 13, wherein inner surfaces of said base and said sidewall have a waterproof liner.

15. The cooler of claim 13, wherein outer surfaces of said sidewall comprise an infrared protective coating.

16. The cooler of claim 13, further comprising at least one channel disposed within said sidewall and disposed between said interior and said spigot for directing contents towards said spigot.

17. The cooler of claim 13, further comprising a seal ring located between said lid and said neck.

18. The cooler of claim 13, wherein each side handle is pivotally attached to said sidewall.

* * * * *